United States Patent [19]

Sandborn

[11] 4,213,280

[45] Jul. 22, 1980

[54] MODULAR UNIT FOR THE CONSTRUCTION OF FLOATING DECKS OF LIQUID STORAGE TANKS

[75] Inventor: Edmund B. Sandborn, Burlington, Canada

[73] Assignee: Novaro Investments Limited, Montreal, Canada

[21] Appl. No.: 939,961

[22] Filed: Sep. 6, 1978

[51] Int. Cl.[2] ..... B65D 87/20; E04C 2/26

[52] U.S. Cl. ..... 52/309.9; 220/218; 220/226

[58] Field of Search ..... 52/309.4–309.16, 52/406, 592, 785, 791, 806, 809; 428/69, 71, 310, 911, 315; 220/216–227

[56] References Cited

U.S. PATENT DOCUMENTS

| | | | |
|---|---|---|---|
| 3,036,342 | 5/1962 | Fino | 220/218 X |
| 3,049,261 | 8/1962 | Wade et al. | 220/216 |
| 3,240,381 | 3/1966 | Smith | 220/216 |
| 3,264,165 | 8/1966 | Stickel | 52/406 X |
| 3,724,704 | 4/1973 | Edwards et al. | 220/226 |
| 3,910,452 | 10/1975 | Szasz | 220/226 |
| 4,018,356 | 4/1977 | Szasz et al. | 220/220 |
| 4,044,083 | 8/1977 | Howe et al. | 428/310 |
| 4,136,222 | 1/1979 | Jonnes | 428/310 |

FOREIGN PATENT DOCUMENTS

| | | | |
|---|---|---|---|
| 2512726 | 9/1976 | Fed. Rep. of Germany | 220/226 |
| 886145 | 1/1962 | United Kingdom | 220/218 |

*Primary Examiner*—J. Karl Bell

[57] ABSTRACT

The disclosure herein describes a modular unit for use in the construction of floating decks used in horizontal or vertical liquid storage tanks; the unit consists of a core of cellular foam plastic and of an envelope sealingly encasing the core, the envelope consisting of a layer of electrically conductive flexible metal and of at least one layer of plastic.

12 Claims, 8 Drawing Figures

MODULAR UNIT FOR THE CONSTRUCTION OF FLOATING DECKS OF LIQUID STORAGE TANKS

FIELD OF THE INVENTION

The present invention relates to a modular unit for use in the construction of floating decks or roofs which are installed in fuel and/or chemical storage tanks to control loss by evaporation.

BACKGROUND OF THE INVENTION

Examples of floating decks of the type described may be found described in U.S. Pat. No. 3,910,452 issued October 7, 1975 as well as in co-pending Canadian patent application Ser. No. 253,504 filed May 27, 1976. These decks are platforms made of inter-connected modular units of predetermined shape which are made of a closed cell foam plastic, such as polyurethane, so that they float on the fluids stored in the tank. The modular units are sealingly connected to one another and the border of the platform wipes the inner walls of the storage tank to reduce the loss by evaporation of the stored fuel or fluid chemicals. The assembled platform is usually covered with one layer of fireproof material, such as asbestos, and a layer of expanded metal to provide rigidity and to dissipate static electricity. With these types of modular units, certain problems are often encountered, one of which is liquid absorption by the polyurethane thus resulting in poor sealing between the units, corrosion of the metal layer and, even in some cases, sinking of the entire deck. Another problem is that liquid absorption in the polyurethane greatly reduces the rigidity of the platform.

OBJECTS AND STATEMENT OF THE INVENTION

It is an object of this invention to provide an improved construction of a modular unit used in the making of floating decks, especially used in liquid storage tanks.

It is a further object of the present invention to provide such a floating deck which is non-corrodible, essentially unsinkable, and impervious to liquids or vapors, including a wide range of chemicals, while being inexpensive and easily assembled.

This is achieved by providing a modular unit which comprises essentially: a core of cellular foam plastic covered with a plastic coated flexible metal. The unit is given a predetermined shape to provide a continuous vapor seal when assembled to other similarly constructed units to form a floating deck. The foam plastic core is entirely clad in the metal thereby eliminating the problem of liquid absorption encountered in the decks of the prior art. By providing adequate grounding, the metal will also serve to prevent buildup of static electricity.

In one form of the invention, the metal is coated with an outer layer of plastic to prevent metal corrosion from chemicals in the stored fluid. The metal may, either singly or in combination with the outer layer, have an inner layer of plastic to increase the adherence between the plastic core and the metal. A treatment of this plastic inner layer, such as flame or corona discharge, is, however, preferred for an adequate bond between core and clad. In some cases, this inner plastic layer is obtained by the pressure produced by the foaming process of urethane or polyisocyanurate within a confined space.

In another form of the invention, an expanded metal mesh is embedded in the foam core to permit fastening means to secure adjacent units together in forming the deck.

Other objects and further scope of applicability of the present invention will become apparent from the detailed description given hereinafter; it should be understood, however, that the detailed description while indicating preferred embodiments of the invention is given by way of illustration only since various changes and modifications within the spirit and scope of the invention will become apparent to those skilled in the art from this detailed description.

DESCRIPTION OF PREFERRED EMBODIMENTS

Referring generally to FIGS. 1–4, there are shown two embodiments of a modular unit made in accordance with the present invention.

Figure 1:
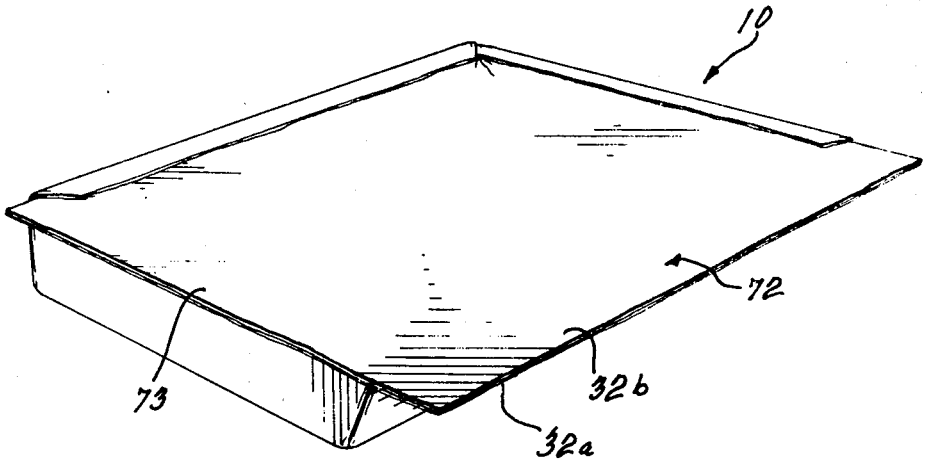
FIG. 1 is a perspective view of one embodiment of a modular unit made in accordance with the present invention.
Figure 2:
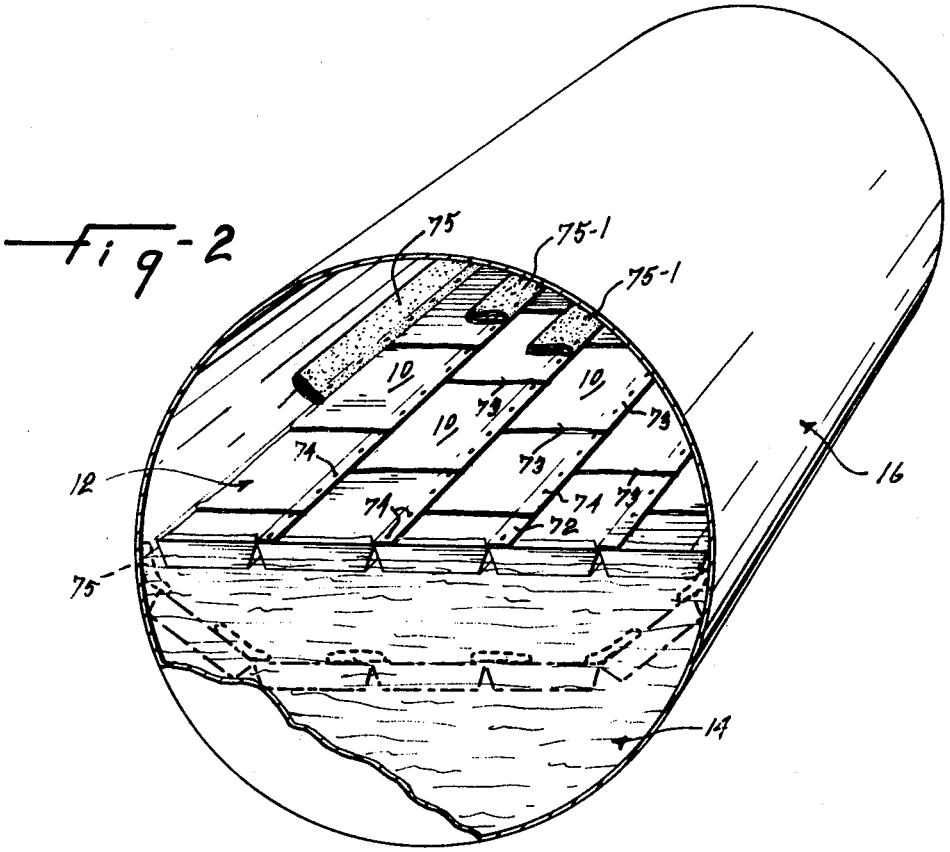
FIG. 2 is a perspective view of a horizontal storage tank showing a floating deck made of inter-connected units, such as illustrated in FIG. 1.

FIGS. 1 and 2 show a modular unit 10 which may be assembled to other similarly constructed units to form a floating deck 12 to be used, for example, to control the loss by evaporation of a liquid 14 stored in a horizontal tank 16.

Figure 3:
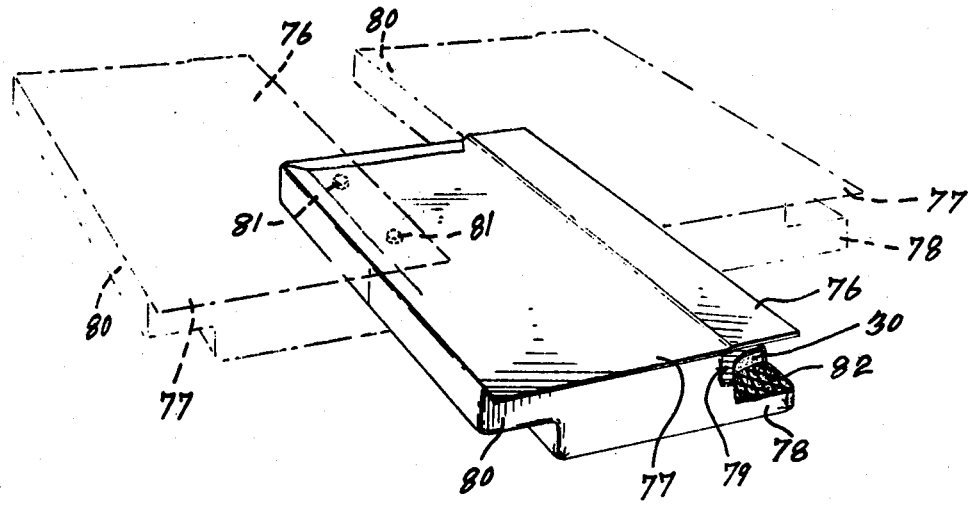
FIG. 3 is a perspective view of another embodiment of a modular unit made in accordance with the present invention.
Figure 4:
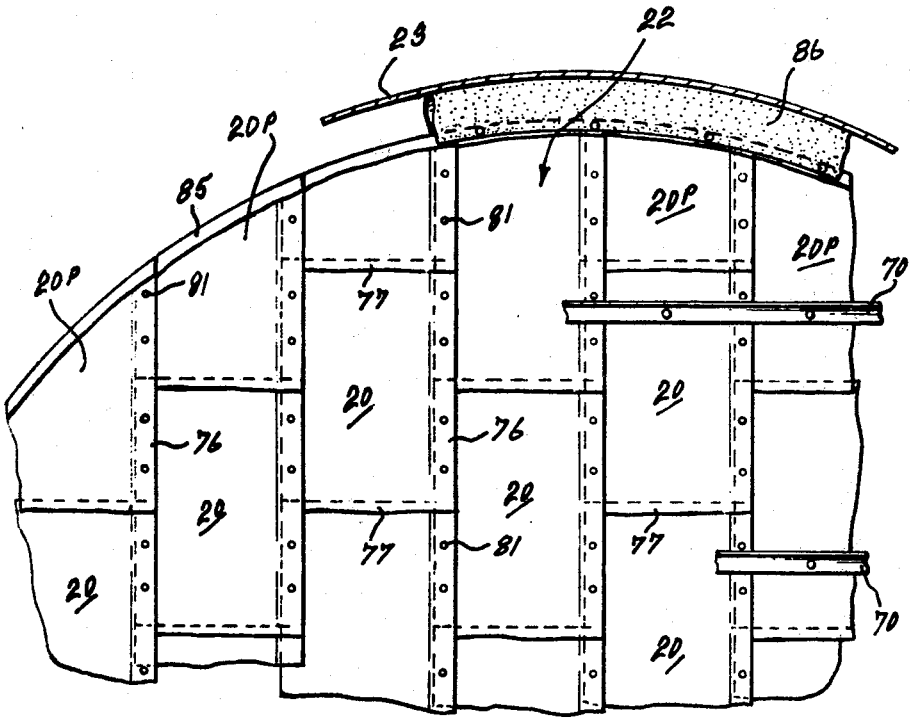
FIG. 4 is a fragmentary top plan view of a floating deck made of assembled units such as illustrated in FIG. 3.

FIGS. 3 and 4 show another construction of a modular unit 20 which may be assembled to other similarly constructed units to form a floating deck 22 to be used to control the loss by evaporation of a stored liquid in a vertical tank 23.

Figure 7:
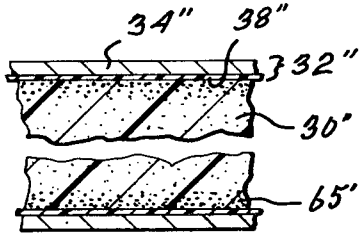
FIGS. 5, 6 and 7 show cross-sections of various constructions of modular units in accordance with the present invention.
Figure 6:
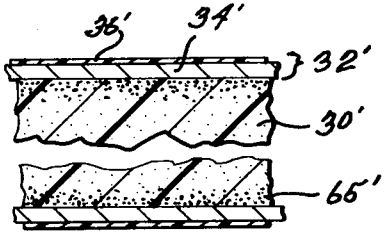
Figure 5:
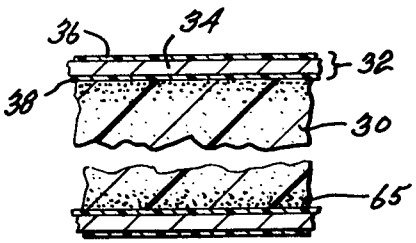

FIGS. 5, 6 and 7 give examples of construction of modular units 10 and 20. Essentially, each modular unit includes a core 30 of fire retardant cellular foam plastic, such as closed-cell urethane, and an envelope 32 completely cladding the core. The envelope 32 of FIG. 5 consists of a layer of flexible metal 34, such as aluminum, between two layers 36 and 38 of a plastic film, such as polyethylene; one example of such envelope 32 including these three layers 34,36,38 is found under the trademarks DOW A282 or ZETABON. The envelope 32' of FIG. 6 consists of only two layers: a flexible metal 34' and an outer layer 36'; one example of such envelope 32' including only two layers is found under the trademark DOW A280. Yet, envelope 32' of FIG. 6 may well consist of a layer of stainless steel 36' with an inner plastic layer 34' formed by the compression of urethane or polyisocyanurate within a confined space during the foaming process (thus, creating a hard skin of plastic between the cellular foam 30' and the metal envelope 36'). The envelope 32'' of FIG. 7 includes a metallic layer 34'' and a plastic inner layer 38''; such envelope is envisaged in cases where the temperature of the fluid stored is extremely high and would affect a plastic outer layer or in which the fluid is of such a nature as to attack either the polyethylene or the aluminum.

Figure 8:
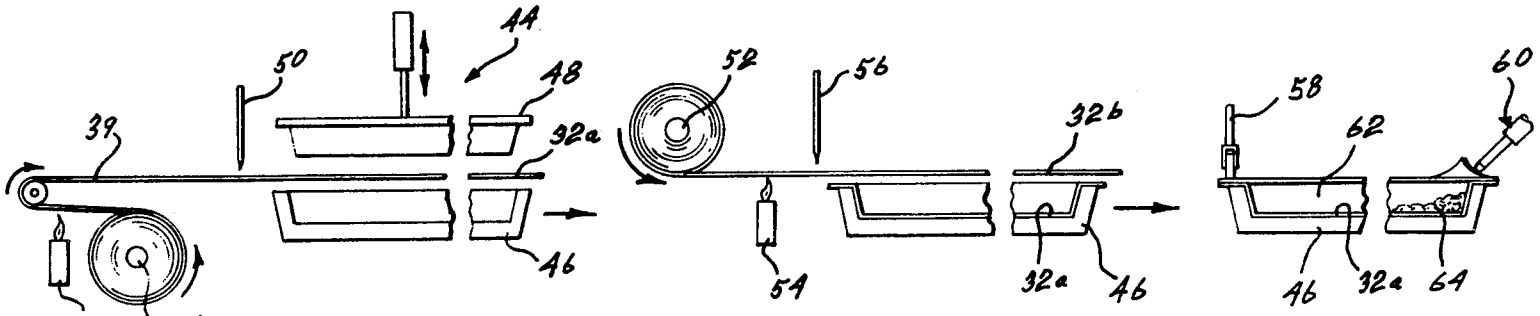
FIG. 8 is a schematic illustration showing some of the steps for making a modular unit in accordance with the present invention.

Referring to FIG. 8, one method of making a modular unit, such as the one illustrated in FIG. 5, is schematically represented. First, a continuous sheet of metal or plastic coated metal 39 is drawn from a roller 40. If plastic coated, the sheet is flame treated at 42 (or it may receive a corona discharge treatment) and then brought to a press 44 that includes a sheet-receiving lower portion 46 and a sheet-forming upper portion 48. Cutter 50 separates a section **32*a* which is then given a predetermined shape by the pressing operation. Another sheet 32*b* is drawn from roller 52 and flame treated at 54. It is cut at 56 and placed over to rest on the edge portions of the cut sheet 32*a*. Three sides of assembled sheets 32*a* and 32*b* are joined together by a pressure hot roller 58 or otherwise. Along the unjoined edges on the fourth side, a mixing and pouring device 60 fills cavity 62 with the mixed components which react to create cellular foam plastic 64. Top and bottom are pressed firmly together in a press and foam expands to form a core of rigid material. Foam creates its own pressure, since its space for expansion is limited, and thus forms a rigid hard skin 65,65', 65'' adjacent to respective envelopes 32,32',32''. This hard skin layer combines with the metal to provide additional rigidity to the unit. When an inner layer is used, as in FIGS. 5 and 7, an improved bond between the polyurethane or polyisocyanurate and the envelope is obtained by the pressure and the heat dissipated from the reaction of the foaming process. FIG. 6 shows that an envelope 32' may also be obtained without an inner layer of plastic coating. In both cases of FIGS. 5 and 6, the outer layer of plastic protects the metal from the corrosive action of salts, bacteria or caustics of various nature. As mentioned above, FIG. 7** pertains to cases where fluids are stored at high temperature beyond the tolerance of the plastic (usually polyethylene) which is utilized when an outer layer of plastic is used.

The modular units described above are extremely light providing excellent floatation and making the decks essentially unsinkable. The fire retardancy of the foam is retained by the plastic-clad aluminum envelope or the stainless steel envelope, since it is not penetrated by vapors from the liquid on which it floats. On the other hand, the urethane or polyisocyanurate, moulded under pressure, developes a hard skin and, together with the aluminum or steel, provides a module of great strength. Still, transverse rigidity of a deck may be increased by providing a series of reinforcing metallic trusses 70 anchored across the top surface of the deck. This provides an important margin of safety in the strength of the deck for men working on the tank when it has been emptied.

The shape of modular unit 10 illustrated in FIGS. 1 and 2 is generally trapezoidal in cross-section with two lip projections 72 and 73 extending along two contiguous sides thereof. These projections consist of envelopes **32*a* and 32*b* described above with reference to FIG. 8. This construction of a modular unit is shown connected in FIG. 2 to similarly constructed units to form the floating deck 12 particularly adapted to be used in a horizontal tank 16. The units 10 are connected to one another by fastening means, such as screws 74, along lip 72. This particular construction of a unit enables the deck shown in dotted lines in FIG. 2 to follow volume variation of the liquid in the tank; this is made possible by the toughness and the flexibility of the plastic clad metal forming part of the envelope. A flexible wiper seal 75 extends between the inner walls of the tank and the border units. Longitudinal wiper seals 75-1 serve to contact the inner walls of the tank for various levels of the liquid in the upper half of the tank; these seals are connected to the deck along edge portions 72**.

FIG. 3 illustrates another shape which may be given to a unit; it includes, along two sides, lip projections 76, and 77; a lap 78 defines with lip projection 76 a channel 79 in which is received the projecting portion 80 of an adjacent similarly constructed unit. The lap and overlap design provides a continuous vapour seal to the deck. Again, fastening means, such as screws 81, extend through a lip 76 of one unit and into the screw holding metal of the projecting portion 80 of an adjacent unit to secure them both together. To ensure proper fastening, an expanded metal mesh 82 may be inserted in the foam body of the unit, either in lap 78 as illustrated in FIG. 3 or in portion 80. This metal mesh may also serve to anchor the metallic trusses, described above, which extend on the upper surface of the deck.

The construction of the modular units of the present invention lends itself to many shapes, the border units being moulded to the shape of the periphery of the tank. Referring to FIG. 4, for example, the peripheral units **20*p* adjacent tank wall 23 may be made from a rectangular shaped unit 20; these units may be cut to a size to fit the circular shape of the tank wall. This may be accomplished by cutting the upper envelope and the foam but leaving the lower envelope uncut which is then folded over (see turned portions 85) and fixedly attached to the remaining portion of the unit. A circumferential flexible seal 86** is then attached to the peripheral border of the deck; the construction of the flexible border seal can be varied depending on the fluid in storage. One such seal carries the flexible metal covered with plastic (for example, Teflon ® on one or both sides of a bronze mesh) to the wall of the tank. Another seal, for example, is an ethafoam cushion with a fiberglass neoprene and urethane envelope firmly held in place by a channel member which is fixed to a second channel member clamped to the border of the deck. A certain number of the modules are perforated by a metal lined leg well, through which a sleeve with an adjustable leg passes for support when the tank is empty.

One example of a platform formed of units 6.25 cm thick made in accordance with the present invention provides a weight of approximately 1.75 lbs. per square foot and each square foot represents a volume of 0.2 cu.ft., giving a density of 9 lbs. per cu.ft. or 0.143 that of water. The platform displaces only about 1/6 of its depth in fuels or approximately 1 cm.

It should therefore be recognized that each unit is essentially a pontoon and that this present invention may also be extended to floating structures such as docks or the like.

The embodiments of the invention in which an exclusive property or privilege is claimed are defined as follows:

1. A modular unit for use in the building of a floating deck used for controlling liquid evaporation in a liquid storage tank, said unit comprising:

a rigid cellular foam plastic core, and;

an envelope sealingly encasing said core defining a barrier against liquid or vapor absorption in said core, said envelope comprising a layer of electrically conductive flexible metal and a layer of plastic material located directly between said metal and said core of foam plastic to provide an increased bond between said core and said metal.

2. A modular unit as defined in claim 1, wherein a second layer of plastic is located over the entire outer surface of said metal to prevent corrosion of said metal by liquids or vapors in said tank.

3. A modular unit as defined in claim 1 or claim 2, wherein said metal is aluminum and said plastic is polyethylene.

4. A modular unit as defined in claim 1 or claim 3, wherein said metal is stainless steel and said plastic is compressed urethane or polyisocyanurate.

5. A modular unit as defined in claim 1 or claim 2, wherein said flexible metal is soft steel and said plastic layer is of polyethylene.

6. A modular unit as defined in claim 1, said core is moulded under pressure to thereby form a peripheral hard skin adjacent said envelope whereby said hard skin together with said metal provide additional strength to said modular unit.

7. A modular unit as defined in claim 1, further comprising expanded metal embedded within said core of cellular foam plastic for securing means for fastening said unit to other similarly constructed adjacently disposed units.

8. A modular unit as defined in claim 1, further comprising lip means and lap means defining channels for receiving complementary lap means on other similarly constructed adjacently disposed units whereby said units may be interconnected to provide a continuous vapor seal.

9. A modular unit as defined in claim 1, wherein said foam plastic is a fire retardant polyurethane.

10. A modular unit as defined in claim 1, wherein said foam is a fire retardant polyisocyanurate.

11. A modular unit as defined in claim 1, comprising metallic leg wells through said core and said envelope to provide a vapor seal for foam surrounding said leg wells.

12. A modular unit as defined in claim 1 wherein said core is formed of expanded plastic moulded under pressure, in situ, within said envelope to thereby form with said envelope a rigid pressured unit.

* * * * *